US006001009A

United States Patent [19]

Kaiser et al.

[11] Patent Number: 6,001,009

[45] Date of Patent: Dec. 14, 1999

[54] FOAM BUFFING PAD OF INDIVIDUAL STRING-LIKE MEMBERS AND METHOD OF MANUFACTURE THEREOF

[75] Inventors: Richard A. Kaiser, Hartland; Scott S. McLain, Wind Lake; Jim D. Schneider, Pewaukee, all of Wis.

[73] Assignee: Lake Country Manufacturing Inc., Hartland, Wis.

[21] Appl. No.: 09/063,670

[22] Filed: Apr. 21, 1998

Related U.S. Application Data

[63] Continuation-in-part of application No. 08/980,660, Dec. 1, 1997.

[51] Int. Cl.[6] ..... B24D 11/00

[52] U.S. Cl. ..... 451/527; 451/532; 451/535; 451/536; 29/432

[58] Field of Search ..... 15/230.13, 230.14, 15/230.16; 29/432, 525; 451/527, 528, 529, 532, 535, 536

[56] References Cited

U.S. PATENT DOCUMENTS

| | | | |
|---|---|---|---|
| Re. 35,021 | 8/1995 | Englund et al. . | |
| D. 291,258 | 8/1987 | Greer, Sr. . | |
| 2,214,351 | 9/1940 | Schlegel . | |
| 2,347,244 | 4/1944 | Colt et al. | 451/527 X |
| 2,690,661 | 10/1954 | Briggs . | |
| 2,803,096 | 8/1957 | Mockiewicz . | |
| 2,833,911 | 5/1958 | Mahmarian . | |
| 3,252,775 | 5/1966 | Tocci-Guilbert . | |
| 3,418,675 | 12/1968 | Meguiar et al. . | |
| 3,727,353 | 4/1973 | Pixley . | |
| 3,857,133 | 12/1974 | Linenfelser . | |
| 4,055,029 | 10/1977 | Kalbow . | |
| 4,111,666 | 9/1978 | Kalbow . | |
| 4,407,040 | 10/1983 | Scharf . | |
| 4,485,919 | 12/1984 | Sandel . | |
| 4,523,411 | 6/1985 | Freerks . | |
| 5,007,128 | 4/1991 | Englund et al. . | |
| 5,016,401 | 5/1991 | Mangus et al. | 451/527 X |
| 5,020,283 | 6/1991 | Tuttle . | |
| 5,185,964 | 2/1993 | Englund et al. . | |
| 5,312,197 | 5/1994 | Abramson . | |
| 5,389,032 | 2/1995 | Beardsley . | |
| 5,396,737 | 3/1995 | Englund et al. . | |
| 5,525,100 | 6/1996 | Kelly et al. | 451/527 |
| 5,679,067 | 10/1997 | Johnson et al. | 451/527 |
| 5,771,525 | 6/1998 | Fulcher et al. . | |

FOREIGN PATENT DOCUMENTS

| | | |
|---|---|---|
| 990142 | 4/1965 | United Kingdom . |

*Primary Examiner*—Timothy V. Eley
*Attorney, Agent, or Firm*—Andrus, Sceales, Starke & Sawall

[57] ABSTRACT

A polymeric foam finishing pad is made by attaching a dense array of individual foam members to a suitable support substrate. The foam members are individually inserted into a support substrate and attached to the substrate by an adhesive layer. When making the foam pad, each of the foam members is preferably folded and inserted into a preformed opening contained in the support substrate, such that each foam member forms a pair of fingers that extend from the front face of the support substrate. The outer tip of each foam finger may include a pair of slits extending into the foam member from the outer tip.

34 Claims, 6 Drawing Sheets

FIG. 12
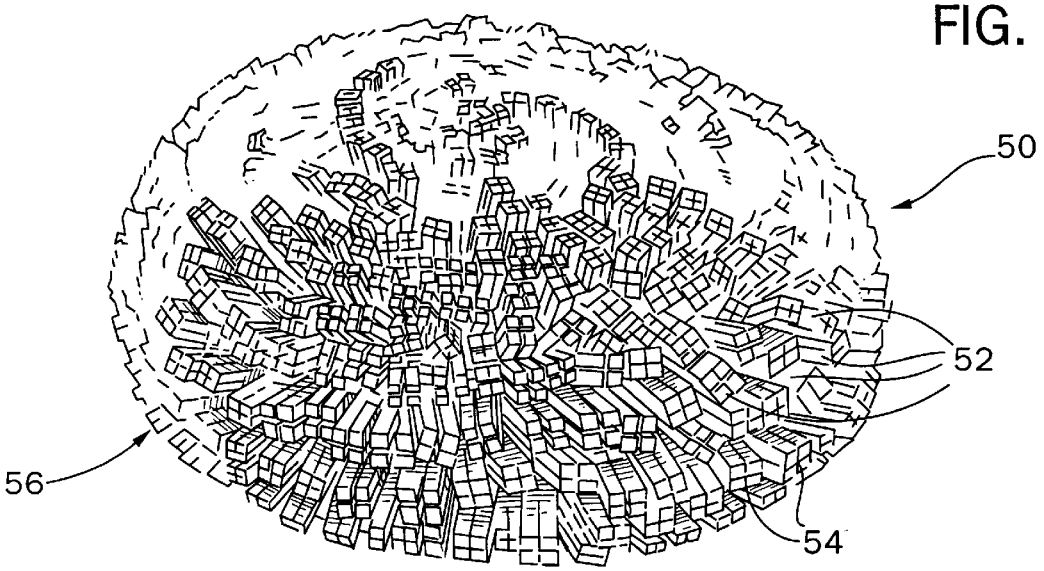
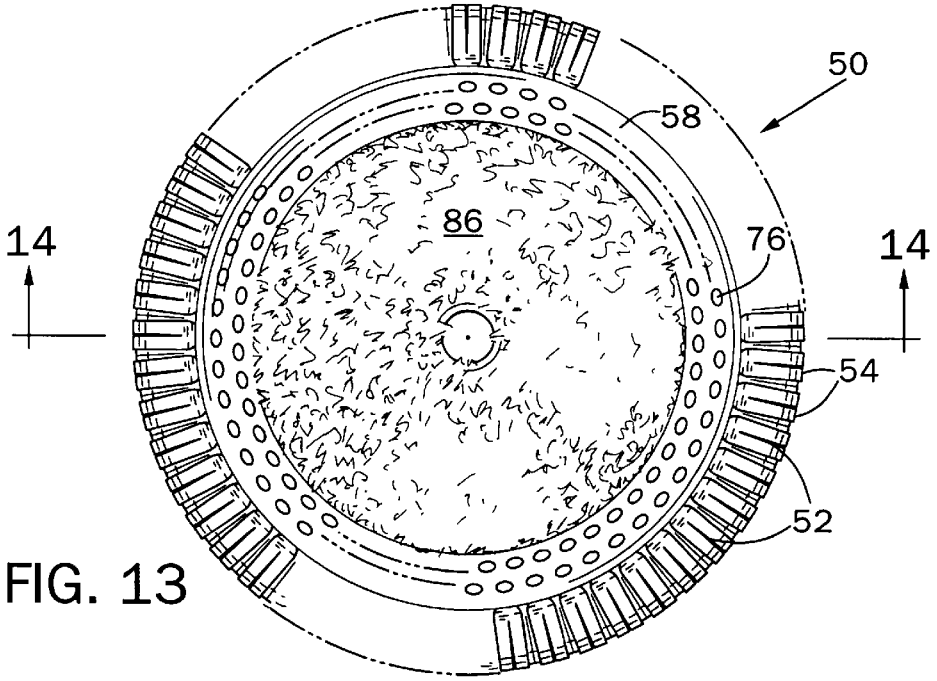
FIG. 13
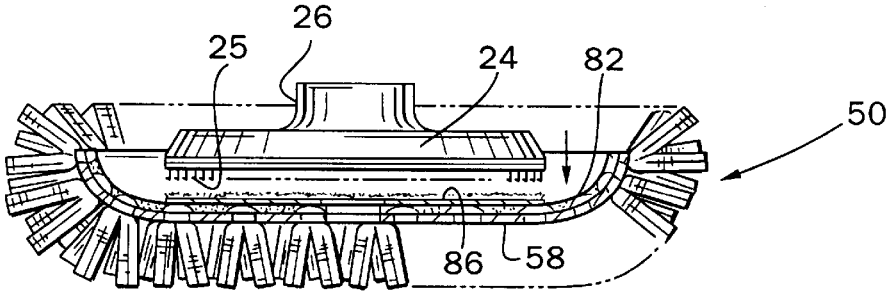
FIG. 14

FIG. 16A
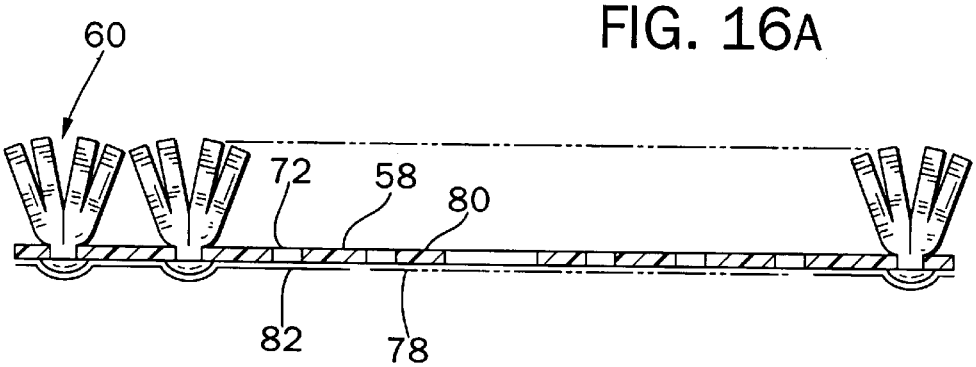
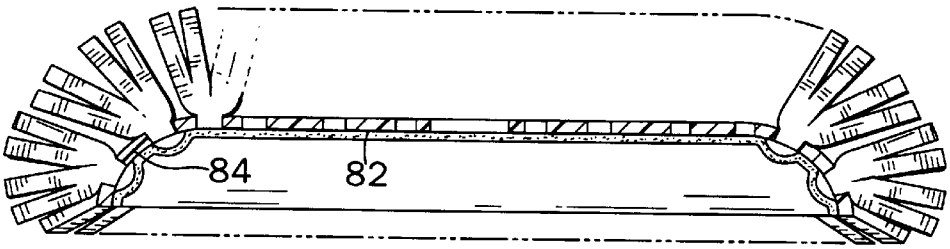
FIG. 16B
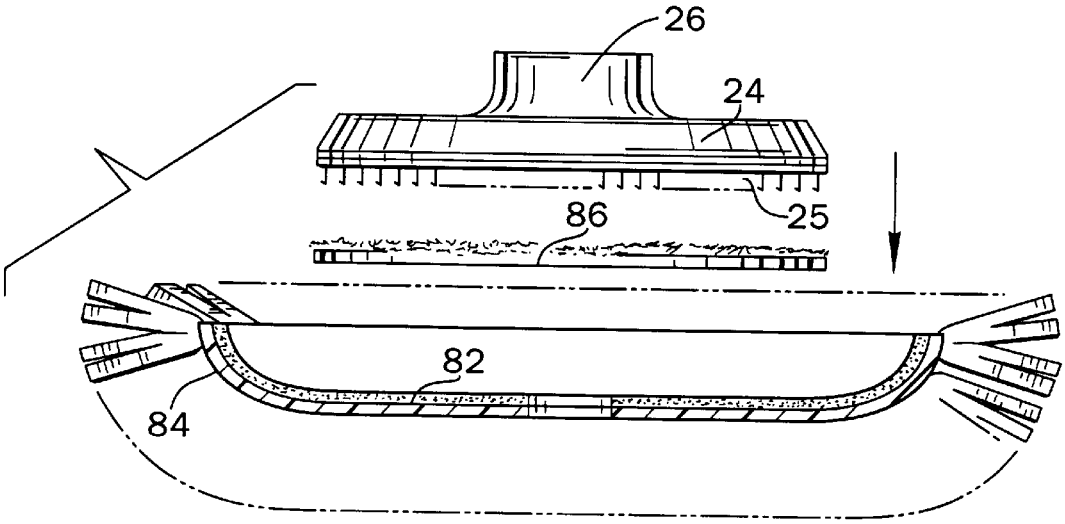
FIG. 16C

FOAM BUFFING PAD OF INDIVIDUAL STRING-LIKE MEMBERS AND METHOD OF MANUFACTURE THEREOF

The present application is a continuation-in-part of patent application Ser. No. 08/980,660, filed on Dec. 1, 1997.

BACKGROUND OF THE INVENTION

The present invention pertains to the field of foam buffing and pads. More specifically, the invention is a rotary pad made from foam string material for buffing and polishing painted or similarly finished surfaces.

Foam buffing pads are now used in many buffing and polishing operations where synthetic or natural fiber pads, such as tufted wool pads, had previously been used. In particular, open cell polyurethane foam pads, with both reticulated and non-reticulated cell structures, have become particularly popular. However, despite certain advantages of polymer foam pads over fibrous and tufted pads, there are still a number of inherent disadvantages attendant the use of foam pads. These disadvantages include the "chatter" or jumping of the pad by excess frictional surface contact between flat working surface portions of the pad and the surface of the work being finished; splattering of the polish or other finishing compound as a result of the compound being thrown radially outwardly by centrifugal force; and, burning of the surface of the work being finished by the high speed outer edge portions of the rotary pad.

Attempts have been made to minimize or eliminate these problems by varying the type and density of foam used and by changing the working surface of the pads. Initially, foam pads were made of a generally cylindrical disc with a flat planar working face and, typically, with a radiused outer edge providing the transition between the working face and the outer cylindrical edge face. However, flat pads are particularly subject to chatter and provide little deterrent to the splatter of polish. Flat faced pads also give the operator little control over variations in the working surface actually in contact with the work surface being finished or polished. One attempt at solving the problems presented by flat foam buffing pads was the introduction of buffing pads having working surfaces with a convoluted or waffle shape. One such pad was previously made by Lake Country Manufacturing, Inc. Although this pad provided variable working surface contact by varying operator-applied pressure, surface contact was somewhat difficult to control and the pad did little to prevent splatter. A different approach to solving the prior art problem is shown in U.S. Pat. No. 5,527,215 where a cylindrical foam pad has a recessed center portion or portions within which the polishing compound may be trapped against radial splatter. This pad also provides the ability the alter the working surface contact by varying operator-applied pressure. However, neither of the foregoing pads adequately solves all of the prior art problems.

One recent attempt to solve the remaining problems inherent in foam buffing pads has resulted in the introduction of a pad having a working face comprising a concave central contact surface which increases radially inwardly with increasing pad compression by the operator. This pad has helped reduce chatter and improved operator control of the working surface contact area.

However, all of the foregoing foam pads are characterized by their monolithic body construction in which the foam bodies are made of a single uniform layer of foam material and, as a result, have an uninterrupted working face regardless of variations in face contour. As a result, monolithic polymeric foam pads remain subject to pad chatter, relatively rapid working surface contamination, undesirable swirl marks, and susceptibility to tearing out of large pieces of the foam body as a result of contact with obstructions during finishing operation.

As a result, foam buffing and finishing pads have never completely replaced pads made with tufted wool fibers or other natural or synthetic fibers. U.S. Pat. No. 2,690,661 shows an attempt to provide a hybrid pad comprising a tufted construction of cotton strands to which an outer layer of cellulose material is intimately bonded. If a pad of this construction was ever commercialized, its use today is not known.

SUMMARY OF THE INVENTION

In accordance with the present invention, a surface finishing pad and its method of manufacture are provided which combine all of the best features of foam pads and tufted pads and, as a result, provides a pad capable of providing a superior finish, substantially extended wear life, superior performance, and substantially extended service time between cleanings.

In a preferred embodiment of the invention, a surface finishing pad includes a support substrate and a plurality of fingers of polymeric foam material which are disposed in a dense array, with the fingers having outer tips which define a pad finishing surface. The fingers may be joined to the support substrate in one of several manners. In the preferred embodiment for use as a rotary finishing pad, the support substrate is circular. Preferably, the support substrate is formed from a plastic material having a plurality of openings.

The polymeric foam material preferably comprises polyurethane. More preferably, the material is an open cell polyurethane which may or may not be reticulated. The outer tips of the fingers may be loaded with an abrasive material, such as abrasive particles. The abrasive particles may be adhesively attached to the fingers or may be incorporated directly into the foam material.

In a presently preferred embodiment of the subject invention, a surface finishing pad comprises a support substrate and a plurality of individual fingers of polymeric foam disposed in a dense array on the support substrate. Each of the foam fingers has an attachment portion that extends through the substrate and is affixed to the back face of the support substrate. Each of the fingers includes an outer tip that extends from a front face of the support substrate, such that the outer tips of the fingers define the pad finishing surface.

Preferably, the surface finishing pad is formed from a plurality of individual foam members that are disposed in a dense array on the support substrate. Each of the foam members includes a first outer tip and a second outer tip. The foam member is folded along an attachment portion positioned between the first and second outer tips. The attachment portion of each foam member is pressed through the support substrate such that the attachment portion of the foam member extends from the back face of the support substrate. In the preferred embodiment of the invention, the attachment portion is adhesively attached to the back face of the support substrate.

In a preferred embodiment, each of the first and second outer tips of the foam member includes a pair of slits extending into the body of the foam member from the respective outer tip. The pair of slits divide each of the outer tips into four contact tips, thereby increasing the amount of surface contact between the surface finishing pad and the painted surface to be finished.

One embodiment of a method for manufacturing a surface finishing pad, in accordance with the present invention, includes the steps of (1) providing a support substrate having a front face and a back face, (2) forming a plurality of individual foam members each having a first outer tip and a second outer tip, (3) folding each of the foam members to form an attachment portion between the first and second outer tips, (4) pushing the attachment portion of each foam member through an opening in the support substrate, and (5) securing the attachment portion to the back face of the support substrate. The foam members may be attached to the support substrate by an adhesive layer, a series of staples, the friction fit between the foam members and the support substrate, or an equivalent method.

Additionally, the method of manufacturing the surface finishing pad can include the step of slitting the outer tip of each foam finger along a pair of orthogonally disposed slit lines. After each outer tip has been slit, each outer tip will include a plurality of contact tips that can be used in surface finishing.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 12 is a top perspective view of a surface finishing pad of the present invention made in accordance with the method of the preferred embodiment.

FIG. 13 is a bottom plan view of the finishing pad shown in FIG. 12.

FIG. 14 is a vertical section taken on line 14—14 of FIG. 13 and additionally showing a backing plate.

FIG. 16A is a side elevation view of the support substrate and the individual foam members inserted therethrough.

FIG. 16B is an inside view of the finishing pad shown in FIG. 16A as molded in accordance with the preferred embodiment of the invention.

FIG. 16C is an exploded side view of the finishing pad and backing plate.

DETAILED DESCRIPTION OF THE INVENTION

Figure 1:
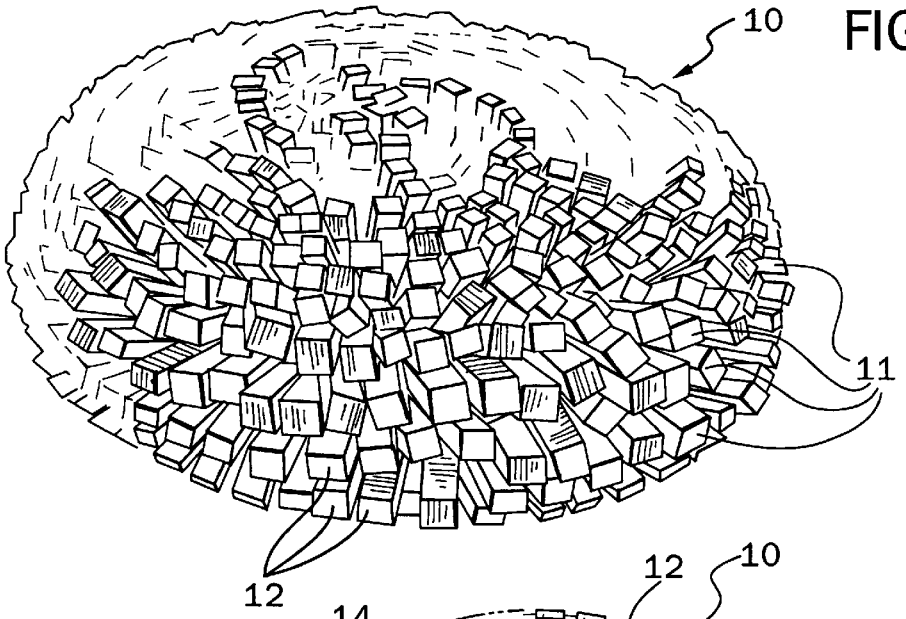
FIG. 1 is a top perspective view of a surface finishing pad of the present invention made in accordance with the method of a first embodiment.
Figure 2:
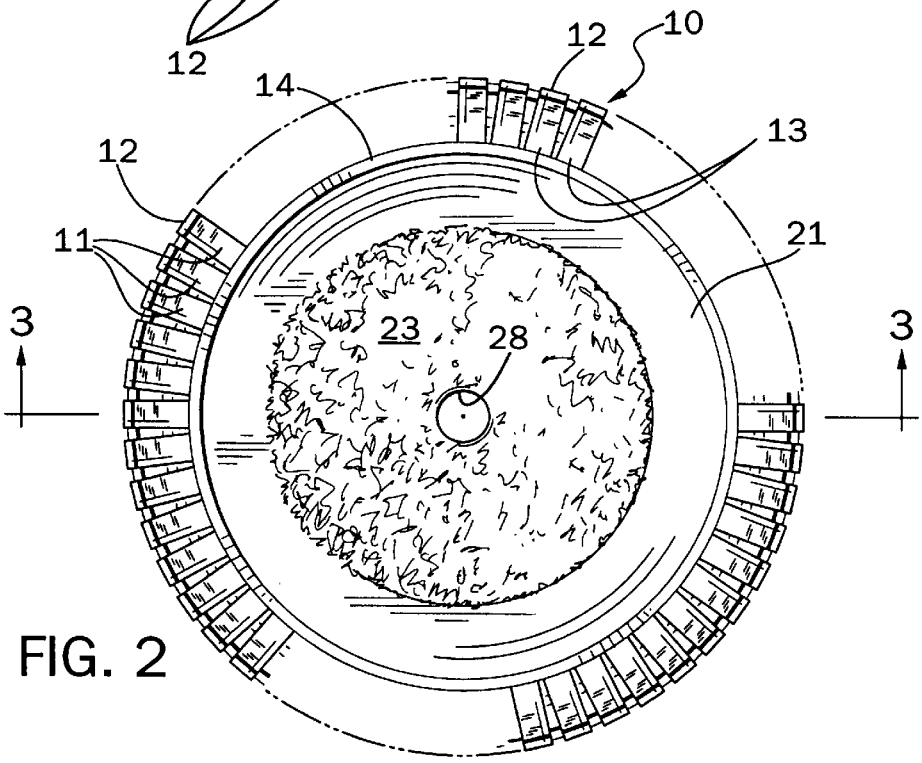
FIG. 2 is a bottom plan view of the finishing pad shown in FIG. 1.

FIG. 1 shows a polymeric foam pad 10 adapted to be used as a buffing or surface finishing pad, such as for automotive paint surface finishing. The pad is comprised of a large number of relatively closely packed foam fingers 11, the individual outer tips 12 of which form the primary active finishing surface of the pad. The base ends 13 of the fingers 11 are attached to a pad substrate 14, as may be seen in the backside view in FIG. 2. The fingers 11 may be formed and attached to the substrate 14 in a number of different ways, as will be described hereinafter. The polymeric foam material is typical of that commonly used in paint finishing pads and may comprise, for example, an open cell polyurethane which may be reticulated or unreticulated. A characteristic difference between finishing pads of the present invention and pads of the prior art is that the pads of this invention are not in the form of a single monolithic layer of foam, but rather are comprised of a dense array of individual fingers.

Figure 3:
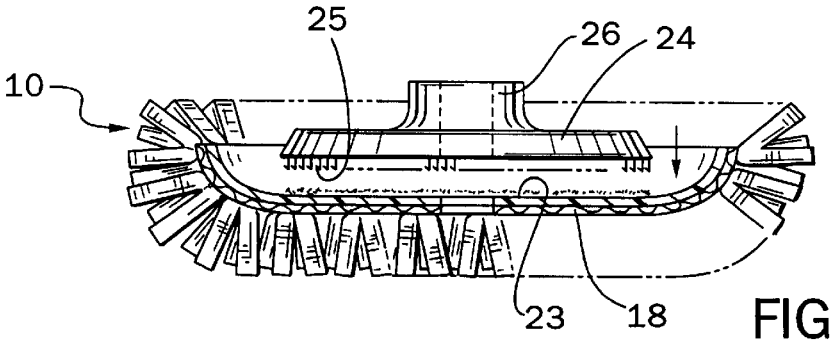
FIG. 3 is a vertical section taken on line 3—3 of FIG. 2 and additionally showing a backing plate.

Finishing pads of the subject invention may be made of either curved or flat construction, both of which are well known in the art. A curved pad is one in which the substrate is formed with a curved outer edge so that the foam wraps around and forms a laterally projecting peripheral buffing or finishing surface, such as shown in FIG. 3. As the name suggests, flat pads simply have a flat substrate, although the surface of the foam pad may be suitably contoured as desired.

Figure 5A:
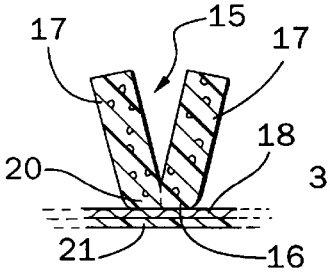
FIGS. 5A and 5B are sectional details showing alternate attachment mechanisms for the polymeric foam strip used to make pads of the present invention.
Figure 6A:
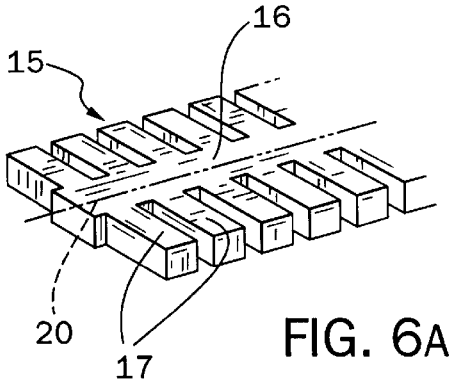
FIG. 6A is a perspective view of a section of the polymeric foam strip of FIGS. 5A and 5B.
Figure 6B:
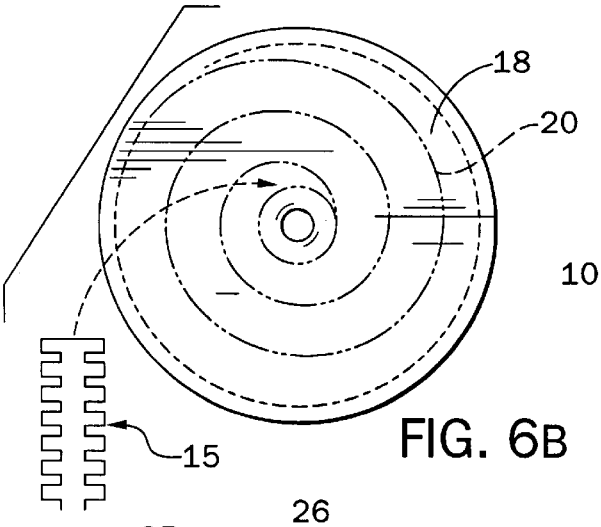
FIGS. 6B–6E are generally schematic representations of the method for making the finishing pad shown in FIGS. 1–3.
Figure 6C:
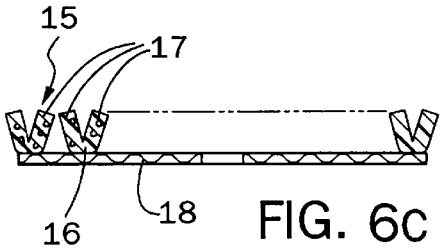

The pad shown in section in FIG. 3 may be manufactured in accordance with a first method which will be described with respect to FIGS. 6A–6E. A long continuous strip 15 of a suitable foam material is formed, as for example in a rotary die cutter, with an elongate body 16 and a series of integral laterally projecting and longitudinally spaced fingers 17. The strip 15 is sewn to a fabric substrate 18 which, conveniently, may comprise a conventional burlap or jute backing commonly used in the manufacture of tufted wool buffing pads. The strip 15 is sewn to the substrate 18 on a spiral stitch line 20 which extends longitudinally along the body 16 of the strip. The compression of the body 16 along the stitch line 20 causes the fingers 17 to turn upwardly, as shown in FIGS. 5A and 6C. Conveniently, stitching may commence at the radial outer edge of the substrate and spiral inwardly to the end of the strip 15 near the center of the substrate, as may best be seen with reference to FIG. 6B.

Figure 6D:
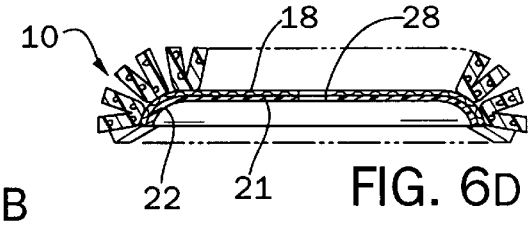
Figure 6E:
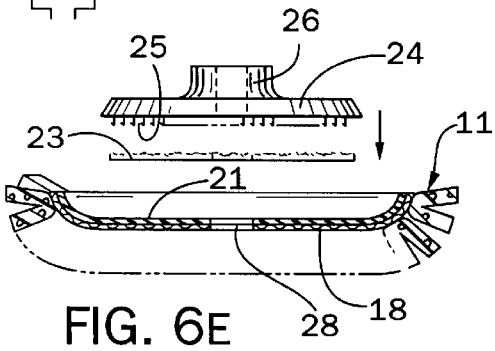

The flat fabric substrate 18 having the foam strip 15 sewn thereto, as shown in FIG. 6C, may then be processed in a number of different ways to provide the unique foam fingered pad of the present invention. Referring also to FIGS. 6D and 6E, the substrate 18 may be curved by heat forming the back face of the substrate to a plastic backing 21 in a suitably shaped mold to provide an upturned peripheral edge 22 on the pad. In addition to the use of a woven natural fiber for the substrate 18, the substrate may also be made from woven synthetic fibers, woven fibers (either natural or synthetic) which are impregnated with a plastic, or solid plastic.

Figure 4:
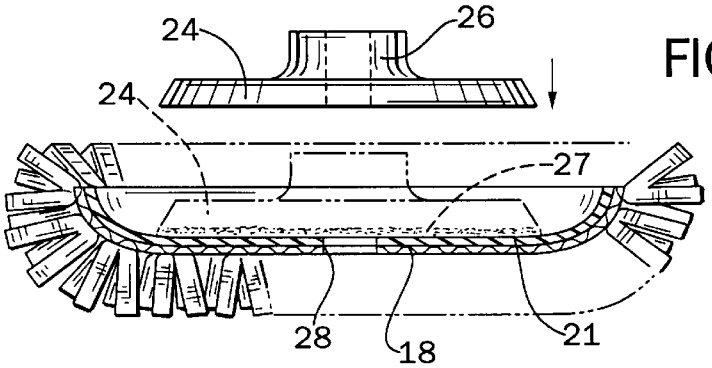
FIG. 4 is a view similar to FIG. 3 showing an alternate backing plate attachment.

The pad 10 may then be mounted on a buffing machine in any of several alternate ways. As shown in FIG. 6E and in FIG. 3, a sheet 23 of loop material, for a conventional hook and loop type fastening system, may be bonded or otherwise adhesively attached to the exposed face of the plastic backing 21. The loop material sheet 23 then cooperates with a conventional backing plate 24 to the face of which is attached a sheet 25 of hook material to cooperate with the loop material sheet 23 in a known manner. The backing plate 24 includes a central hub 26 which is internally threaded for attachment to the rotary stub shaft of a conventional buffing machine (not shown). Alternately, as shown in FIG. 4, the backing plate 24 may be bonded directly to the plastic backing 21 with a suitable adhesive layer 27. In a further alternate means for mounting, the fabric substrate and plastic backing 21 may be provided with a central hole 28 for receipt of the rotary buffing machine shaft for direct bolted mounting thereto, using a nut and washer (not shown) attached from the front face of the pad 10.

Figure 5B:
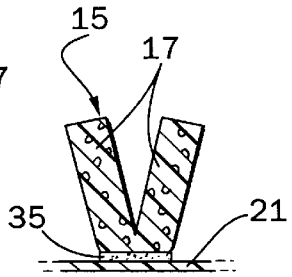

In FIG. 5B, an alternate means for attaching the foam strip 15 to a substrate is shown. By adhesively bonding the body 16 of the strip directly to a rigid plastic backing, as with a glue line 35, an intermediate fabric substrate may be eliminated. In lieu of a glued connection, alternate methods of attaching the foam strip 15 to the plastic backing 21 may include sonic welding or solvent bonding.

Figure 7:
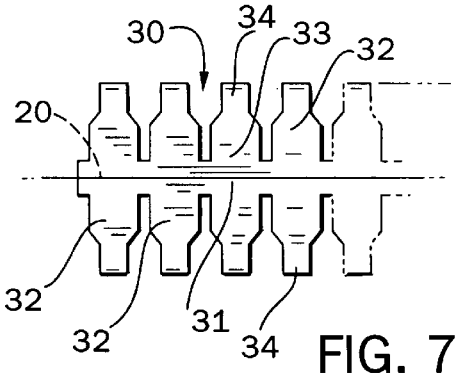
FIG. 7 is a top plan view of an alternate form of the polymeric foam strip used in making finishing pads of the subject invention.

As shown in FIG. 7, an alternate foam strip 30 includes a similar elongate body 31 running the full length of the strip, as in strip 15 of the previously described embodiment. The fingers 32, however, are formed somewhat differently, having a stepped configuration with wider base portions integrally attached to the body 31 and narrower outer ends 34 which define the working tips in the completed pad, as described above. The finishing pad of the present invention lends itself to use of a wide range of sizes and shapes of foam strips which may be readily custom cut for a particular application.

Figure 8:
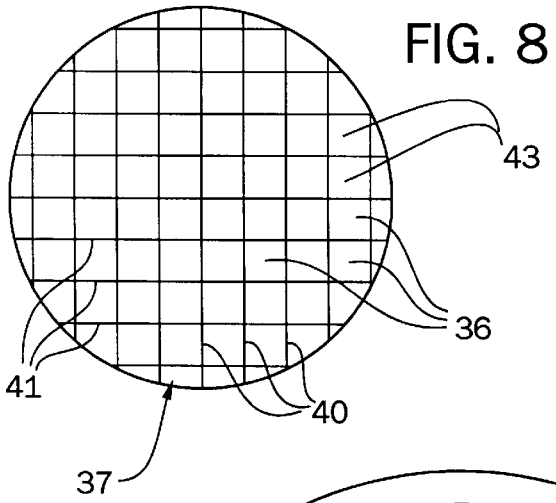
FIG. 8 is a top plan view of a finishing pad in accordance with another embodiment of the invention.
Figure 9:
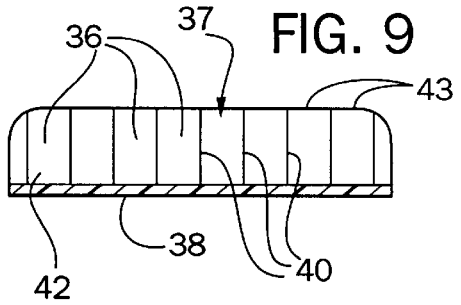
FIG. 9 is a side elevation view of the pad shown in FIG. 8.

Referring to FIGS. 8 and 9, there is shown an alternate construction in which foam fingers 36 are formed in a conventional polyurethane or other foam pad body 37. Thus, an open cell polyurethane foam pad body 37 of conventional construction is attached to a suitable substrate 38 which may, for example, be a plastic backing similar to that previously described. After attachment of the pad body to the substrate, the pad is cut on sets of mutually perpendicular first slit lines 40 and second slit lines 41. Preferably, the slit lines 40 and 41 extend completely through the pad body 37 all the way to the substrate 38. The resulting pad comprises a plurality of fingers 36 disposed in a dense array and having their individual base ends 42 attached to the substrate 38 and their outer tips 43 defining the pad finishing face 43. Some or all of either group of slit lines 40 and 41 may extend only partially into the pad body 37 less than the full thickness thereof.

Figure 10:
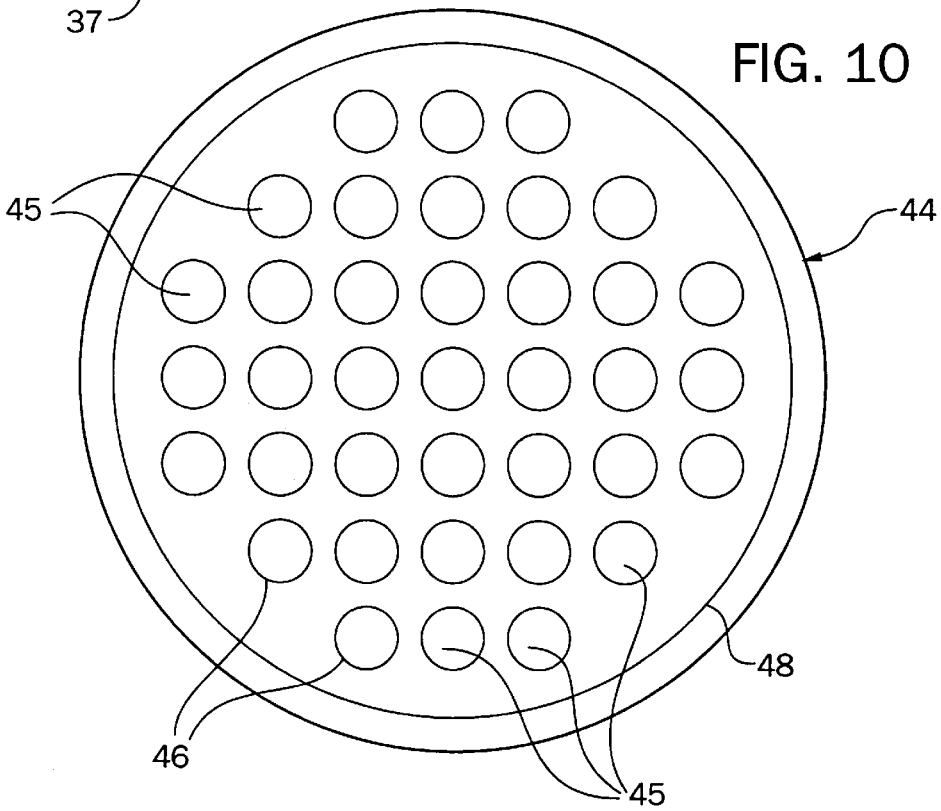
FIG. 10 is a top plan view of a pad showing a further embodiment of the present invention.
Figure 11:
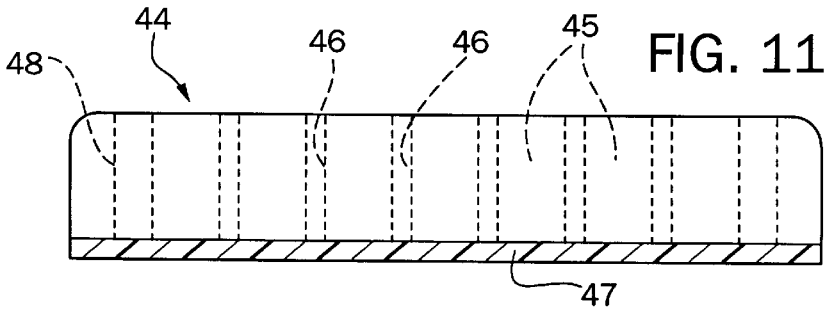
FIG. 11 is a side elevation of the pad shown in FIG. 10.

Referring now to FIGS. 10 and 11, a conventional flat faced circular pad body 44, similar to the body 37 of the previously described embodiment, may have a pattern of fingers 45 slit therein which is substantially different from the fingers 36 of FIGS. 8 and 9. In this embodiment, the fingers 45 comprise cylindrical bodies 46 which are individually cut through the foam body 44 generally perpendicular to the pad substrate 47. The pattern as well as the shape and size of the fingers 45 may be varied considerably, as desired for changing the buffing characteristics of the pad. In the particular construction shown in FIG. 10, the pad is provided with a large circular slit 48 near the outer periphery. This has been found to add to the pad flexibility and to also provide an outer containment ring to reduce splatter of finishing compound. As with the embodiment of FIGS. 8 and 9, the slit lines preferably extend the full depth of the pad body 44, but any or all of the slit lines may be limited to less than the full depth.

Referring now to FIGS. 12–14, thereshown is a preferred embodiment of a polymeric foam pad 50 adapted to be used as a buffing or surface finishing pad, such as for automotive paint surface finishing. As with the previously described embodiments, the pad 50 is comprised of a large number of relatively closely packed foam fingers 52. Each of the individual foam fingers 52 includes an outer tip 54. The plurality of outer tips 54 combine to form a pad finishing surface 56 for the foam pad 50. Each of the foam fingers 52 is attached to a support substrate 58, as may be seen in the backside view in FIG. 13. The foam fingers 52 may be formed and attached to the support substrate 58 in a number of different ways, as will be described hereinafter. The polymeric foam material used to construct each of the foam fingers 52 is typically of that commonly used in paint finishing pads and may comprise, for example, an open cell polyurethane which may be reticulated or unreticulated.

As with the previous embodiments, the foam pad 50 of the preferred embodiment may be made of either curved or flat construction, both of which are well known in the art. A curved foam pad is one in which the support substrate is formed with a curved outer edge so that the foam wraps around and forms a laterally projecting peripheral buffing or finishing surface, such as shown in FIG. 14. As the name suggests, flat pads simply have a flat support substrate, although the surface of the foam pad may be suitably contoured as desired.

Figure 15A:
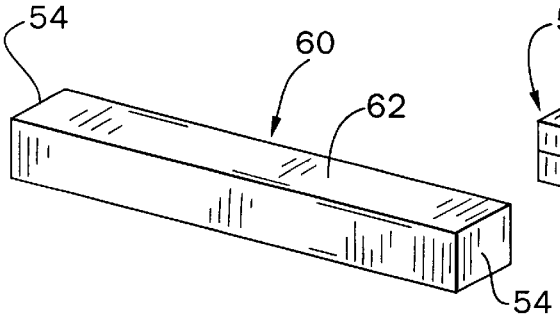
FIG. 15A is a perspective view of an individual foam member used to make the pads of the present invention.

The foam pad 50 shown in section in FIG. 14 may be manufactured in accordance with one presently preferred method that will be described with respect to FIGS. 15A–15F. Initially, a plurality of individual foam members 60 of a suitable foam material are formed in the shape as shown in FIG. 15A. Each of the foam members 60 includes an elongated body 62 and a pair of outer tips 54. In the preferred embodiment of the invention, each of the foam members 62 has a generally rectangular profile, although other profiles could be used while operating within the scope of the present invention.

Figure 15B:
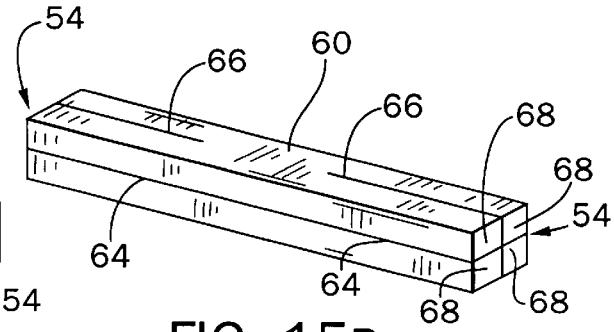
FIG. 15B is a perspective view of the foam member shown in FIG. 15A, further including a series of slits formed in accordance with the method of the preferred embodiment.

In a preferred embodiment of the invention, a first slit 64 and a second slit 66 are formed in each end of the foam member 60, such that each of the slits 64 and 66 extend longitudinally from one of the respective outer tips 54, as shown in FIG. 15B. As can be seen in FIG. 15B, the first slit 64 and the second slit 66 are orthogonally disposed with respect to each other such that the first slit 64 and the second slit 66 form a plurality of contact tips 68 along each of the outer tips 54. By dividing each outer tip 54 into a plurality of contact tips 64, the amount of contact between the foam pad 50 and the surface being finished is increased to provide more effective finishing. Each of the first and second slits 64, 66 extend inward from one of the outer tips 54 and terminates at a point spaced from the center of the foam member 60. Although the preferred embodiment is described as including the first slit 64 and the second slit 66, it should be understood that the foam pad 50 of the present invention could be constructed in an identical manner as described below without the inclusion of the first slit 64 and the second slit 66.

Figure 15C:
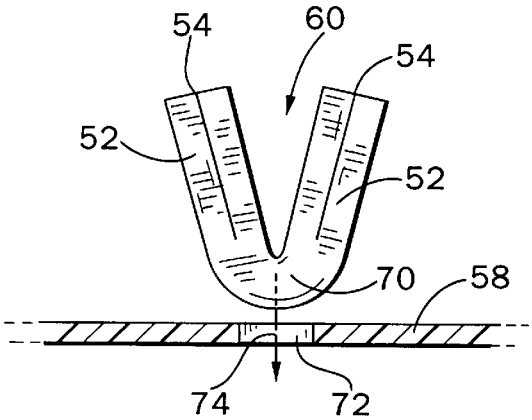
FIGS. 15C and 15D are sectional details illustrating the method of inserting each individual foam member into the backing member.

After the foam member 60 has been formed as shown in FIG. 15B, the foam member 60 is folded generally in half to form a folded portion 70, as shown in FIG. 15C. When the foam member 60 has been folded as shown in FIG. 15C, the foam member 60 forms a pair of foam fingers 52. Each of the foam fingers 52 generally extends from one of the outer tips 54 to the folded portion 70.

Figure 15D:
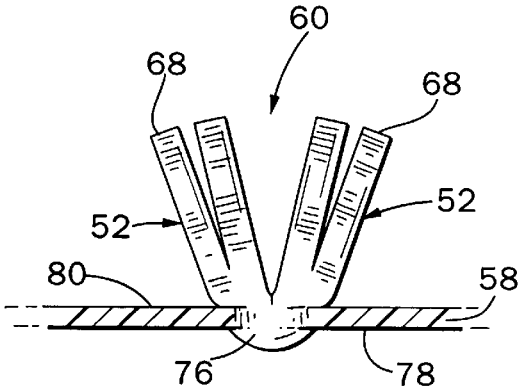
Figure 15E:
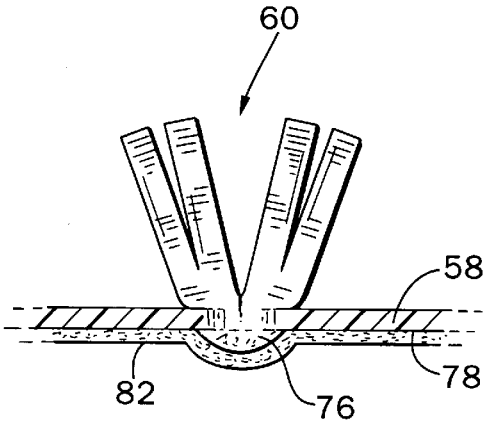
FIG. 15E is a sectional detail showing the securing method for the foam member of the present invention.
Figure 15F:
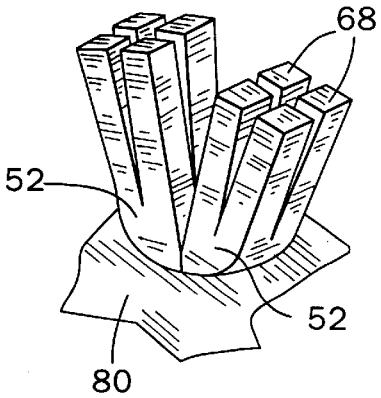
FIG. 15F is a detailed perspective view of the foam member as inserted through the support substrate.

After the foam member 60 has been folded as described, the foam member 60 is pressed through an opening 72 formed in the support substrate 58, as shown by arrow 74. In the preferred embodiment of the invention, each of the foam members 60 is pressed through the support substrate 58 using a modified brush filling method and machine in a manner similar to the formation of a tufted wool buffing pad. After the foam member 60 has been pressed through the opening 72, as shown in FIG. 15D, an attachment portion 76 of the foam member 60 extends from a back face 78 of the support substrate 58. In the preferred embodiment of the invention, each of the openings 72 formed in the support substrate 58 is sized slightly smaller than the folded portion 70 of the foam member 60, such that the compression of the folded portion 70 when pressed through the opening 72 causes each of the foam fingers 52 to turn upwardly, as shown in FIG. 15D. Additionally, the compression of the foam member 60 causes each of the plurality of contact tips 68 to separate, as best shown in FIGS. 15D and 15F. Positive separation of the contact tips 68 aids in increasing the amount of contact between each of the fingers 52 and the surface being finished.

In the preferred embodiment of the invention, the support substrate 58 is formed from a plastic material having openings 72 preformed therein in a pattern as can be partially seen in FIG. 13. Alternatively, the opening 72 may be formed by a punch included on the brush filling machine, such that the openings 72 would be formed just before the foam members 60 are pressed through the openings 72 by the brush filling machine. Additionally, the support substrate 58 could be formed from a fabric material similar to that used in tufted wool buffing pads and the foam members 60 pressed therethrough without the requirement of preformed holes.

After each of the foam members 60 has been folded and pressed through one of the openings 72, each of the foam members 60 forms a pair of foam fingers 52. Each of the foam fingers 52 extends from a front face 80 of the support substrate 58. Thus, the outer tip 54 of each foam member 60, which is divided into four contact tips 68 in the preferred embodiment, forms the pad finishing surface 56 for the foam pad 50.

Once the plurality of foam members 60 have been inserted into the plurality of openings 72 contained in the support substrate 58 in a dense array, the attachment portion 76 of each foam member 60 is secured to the back face 78 of the support substrate 58. In the preferred embodiment of the invention, a layer of adhesive 82 is formed along the entire back face 78 of the support substrate 58, as shown in FIG. 15E. The adhesive layer 82 securely bonds the attachment portion 76 of each foam member 60 to the support substrate 58. After the adhesive layer 82 has been formed, the completed foam pad 50 includes the securely attached foam fingers 52 extending from the front face 80 of the support substrate 58, as is best shown in FIG. 15F.

In a contemplated alternate embodiment, the attachment portion 76 of each foam member 60 could be secured to the support substrate 58 by a mechanical attachment means, such as a conventional staple. Alternatively, each of the foam members 60 could remain secured to the support substrate 58 by only the friction fit between the attachment portion 76 and the opening 72 through which it is pressed. In a surface finishing pad constructed without the use of a separate attachment means, the size of the openings 72 in the support substrate 58 could be decreased to increase the strength of the friction fit between the foam member 60 and the support substrate 58.

Although the foam pad 50 of the present invention has been described as being formed by a plurality of foam members 60 folded generally in half and inserted into the support substrate 58 to define a pair of foam fingers 52, in an alternate embodiment the length of the foam member 60 could be shortened and one of the outer tips 54 pressed through an opening in the support substrate 58. With one of the outer tips 54 pressed through one of the openings 72, the adhesive layer 82 would then hold the outer tip 54 to the back face 78 of the support substrate 58. In this manner, each of the foam members 60 would define only one foam finger 52, rather than the pair of foam fingers 52 described above.

The flat support substrate 58 having the plurality of foam members 60 adhered thereto, as shown in FIG. 16A, may then be processed in a number of different ways to provide the unique foam fingered pad 50 of the present invention. Referring also to FIGS. 16B and 16C, since the support substrate 58 is preferably formed from a plastic material, the support substrate 58 may be curved by heat forming in a suitably shaped mold to provide an upturned peripheral edge 84 on the pad 50. Alternatively, if a woven natural fiber is utilized for the support substrate 58, the substrate may be curved by heat forming the substrate to a plastic backing (not shown) and subsequently the plastic backing may be heat molded as described above.

The foam pad 50 may then be mounted on a buffing machine in any of several alternative ways. As shown in FIGS. 14 and 16C, a sheet 86 of loop material, for a conventional hook and loop-type fastening system, may be bonded or otherwise adhesively attached to the adhesive layer 82. The loop material sheet 86 then cooperates with the conventional backing plate 24 to the face of which is attached the sheet 25 of hook material to cooperate with the loop material sheet 86 in a known manner. The backing plate 24 includes the central hub 26 which is integrally threaded for attachment to the rotary stub shaft of a conventional buffing machine (not shown). Alternatively, the backing plate 24 may be bonded directly to the adhesive layer 82 with a suitable layer of adhesive.

The foam fingers of any of the pad embodiments described above may have abrasive particles embedded therein or attached thereto to provide a more aggressive finishing pad. The abrasive particles may be attached to the tips of the fingers by an adhesive or some other bonding process, or the abrasive particles may be incorporated directly into the foam material when it is manufactured.

Various alternatives and embodiments are contemplated as being within the scope of the following claims particularly pointing out and distinctly claiming the subject matter regarded as the invention.

We claim:

1. A surface finishing pad comprising:

a support substrate having a front face and a back face;

a plurality of individual fingers of polymeric foam material disposed in a dense array on the support substrate, each finger having an attachment portion extending through the support substrate and an opposed outer tip extending from the front face, such that the outer tips of the plurality of fingers define a pad finishing surface.

2. The surface finishing pad of claim 1 wherein the attachment portion of each finger is adhesively attached to the back face of the support substrate.

3. The surface finishing pad of claim 1 wherein each finger includes at least one slit extending from the outer tip toward the attachment end.

4. The surface finishing pad of claim 1 wherein each finger includes a first and a second slit, each slit extending from the outer tip toward the attachment end such that each outer tip includes four contact tips.

5. The surface finishing pad of claim 4 wherein the first and the second slits are orthogonally disposed with respect to each other.

6. The surface finishing pad of claim 1 wherein the support substrate includes a plurality of openings extending between the front face and the back face, each opening receiving one of the fingers.

7. The surface finishing pad of claim 1 wherein the polymeric foam material comprises polyurethane.

8. The surface finishing pad of claim 7 wherein the polymeric foam material comprises open cell polyurethane.

9. The surface finishing pad of claim 7 wherein the polymeric foam material comprises reticulated open cell polyurethane.

10. The surface finishing pad of claim 1 wherein the outer tip of each finger is loaded with abrasive particles.

11. A surface finishing pad comprising:

a support substrate having a front face and a back face; and a plurality of individual foam members disposed in a dense array along the support substrate, each foam member having a body extending between a first outer tip and a second outer tip, wherein each foam member is folded along an attachment portion positioned between the first and second outer tips and pressed through the support substrate such that the attachment portion of the foam member extends from the back face of the support substrate and the first and second outer tips each extend from the front face of the support substrate to define a pad finishing surface.

12. The surface finishing pad of claim 11 wherein the attachment portion of each foam member is attached to the back face of the support substrate.

13. The surface finishing pad of claim 12 wherein the attachment portion of each foam member is attached to the back face of the support substrate by an adhesive layer.

14. The surface finishing pad of claim 11 wherein the first and second outer tips of each foam member each includes a first and a second slit, each slit extending from the respective outer tip toward the attachment portion, such that each outer tip includes four contact tips.

15. The surface finishing pad of claim 11 wherein the support substrate includes a plurality of openings extending between the front and the back face, each opening receiving the attachment portion of one of the foam members.

16. The surface finishing pad of claim 11 wherein each of the individual foam members defines a pair of fingers, each finger extending from the attachment portion to one of the outer tips.

17. The support finishing pad of claim 11 wherein the foam material comprises polyurethane.

18. The surface finishing pad of claim 17 wherein the foam material comprises open cell polyurethane.

19. The surface finishing pad of claim 17 wherein the foam comprises reticulated open cell polyurethane.

20. The surface finishing pad of claim 11 wherein the substrate is made from plastic.

21. The surface finishing pad of claim 11 further comprising a backing member securely attached to at least a portion of the back face of the support substrate.

22. A method of manufacturing a surface finishing pad comprising the steps of:

providing a support substrate having a front face and a back face;

forming a plurality of individual foam fingers each having an outer tip;

arranging the foam fingers in a dense array along the support substrate; and pushing an attachment portion of each foam finger through the support substrate such that the attachment portion of each foam finger extends from the back face of the support surface, wherein the outer tips of the foam fingers extend from the front face of the support substrate to define a pad finishing surface.

23. The method of claim 22 further comprising the step of securing the attachment portion of each foam finger to the back face of the support substrate.

24. The method of claim 22 wherein each foam finger is secured to the back face by an adhesive layer.

25. The method of claim 22 further comprising the steps of:

forming a plurality of holes in the support substrate between the front face and the back face; and pushing one of the foam fingers into each of the holes formed in the support substrate.

26. The method of claim 22 further comprising the steps of slitting the outer tip of each foam finger such that the outer tip of each foam finger includes a plurality of contact tips.

27. The method of claim 26 wherein the step of slitting includes forming two orthogonally disposed slits in the outer tip of each foam finger such that the outer tip includes four contact tips.

28. A method of manufacturing a surface finishing pad comprising the steps of:

providing a support substrate having a front face and a back face;

forming a plurality of individual foam members each having a first outer tip and a second outer tip;

folding each of the foam members to form an attachment portion between the first and second outer ends, such that each foam member defines a first foam finger extending from the attachment portion to the first outer tip a second foam finger extending from the attachment portion to the second outer tip;

arranging the foam members in a dense array along the support substrate; and pushing the attachment portion of each foam member through the support substrate such that the attachment portion of each foam member extends from the back face of the support surface, wherein each of the foam fingers extends from the front face of the support substrate such that the outer tips define a pad finishing surface.

29. The method of claim 28 further comprising the step of forming a plurality of openings in the support substrate, each opening receiving the attachment portion of one of the foam members.

30. The method of claim 28 further comprising the step of securing the attachment portion of each foam member to the back face of the support substrate.

31. The method of claim 30 wherein the attachment portion of each foam member is secured to the back face by an adhesive layer.

32. The method of claim 28 further comprising the steps of slitting the outer tip of each foam finger such that the outer tip of each foam finger includes a plurality of contact tips.

33. The method of claim 32 wherein the step of slitting includes forming two orthogonally disposed slits in the outer tip of each foam finger such that the outer tip includes four contact tips.

34. The method of claim 28 further comprising the step of attaching abrasive particles to the outer tips of each foam member.

* * * * *